United States Patent [19]

Bühler

[11] Patent Number: 4,702,301

[45] Date of Patent: Oct. 27, 1987

[54] INSTALLATION FOR THE PRODUCTION OF HORIZONTALLY DIVIDED FLASKLESS SAND BLOCK MOLDS

[76] Inventor: Eugen Bühler, Schleifweg 3, 8877 Burtenbach, Fed. Rep. of Germany

[21] Appl. No.: 765,479

[22] Filed: Aug. 14, 1985

[30] Foreign Application Priority Data

Oct. 15, 1984 [DE] Fed. Rep. of Germany ..... 3437702

[51] Int. Cl.[4] ..... B22D 47/02

[52] U.S. Cl. ..... 164/168; 164/183; 164/201; 164/375

[58] Field of Search ..... 164/183, 185, 160.1, 164/168, 201, 214, 242, 375, 409, 29, 38

[56] References Cited

U.S. PATENT DOCUMENTS 3,540,516 11/1970 Taccone ..... 164/29
4,108,234 8/1978 Shine ..... 164/183
4,586,555 5/1986 Buhler ..... 164/375

FOREIGN PATENT DOCUMENTS 8102698 10/1981 PCT Int'l Appl. .
2098896 12/1982 United Kingdom .

*Primary Examiner*—Nicholas P. Godici
*Assistant Examiner*—G. M. Reid
*Attorney, Agent, or Firm*—Jones, Tullar & Cooper

[57] ABSTRACT

For the production of horizontally divided flaskless foundry molds a mold making plant is employed consisting of a vacuum mold blowing machine, joined with a casting and cooling line and a shake out station. The vacuum mold blowing machine is provide with a pattern plate swapping device and designed in the form of a single station mold making maching, in which drags and copes of a mold are produced alternately. The single mold flask is part of the mold making machine and has means for stripping it from a drag or cope before removal of the same from the machine. This makes it possible to have one core insertion station with space for a plurality of drag without having more than one machine flask.

10 Claims, 2 Drawing Figures

20
18
19
21
17
22
25
1
16

INSTALLATION FOR THE PRODUCTION OF HORIZONTALLY DIVIDED FLASKLESS SAND BLOCK MOLDS

BACKGROUND OF THE INVENTION

The invention relates to a method and an installation for the mechanical production of horizontally divided flaskless sand molds made up of a cope (used herein to denote the top part of a mold) and a drag (used herein to mean the lower part of a mold). It constitutes a further development of the invention disclosed in U.S. Pat. No. 4,586,555.

This mold making installation is equipped with a vacuum mold blowing machine, on which the compacted masses of sand forming the drags and copes are produced alternately using a seqential controller. For this purpose the single station mold making machine possesses a mold frame, which is made up of a lower and an upper flask and a hollow pattern plate carrier, able to be inverted in the mold making station and which is divided by a horizontal partition into two chambers and on both sides is fitted with the pattern plates for the lower and upper components of the block mold, i.e. the masses of compacted sand forming the drag and cope. During the production of the drag the empty cope or upper flask is placed over the drag or lower flask and surrounds the lower end of the sand bin which is able to be shut off at its lower end by a blowing and pressing grid. Prior to the ensuing production of the cope the lower flask with the drag therein is moved out of the mold making station and simultaneously inverted and deposited in a core insertion station, from which, after the lifting of the cope clear of the pattern plate it is moved back into the mold making station. In the mold making station the upper flask is then lowered onto the lower flask and the assembled mold is stripped and then sent on its way along a casting and cooling line.

Although this mold making machine was intended to have a low overall height, this aim was not satisfactorily achieved owing to the placing of the machine flasks vertically over each other in the starting and final positions and to the necessary clearance for the inversion fo the block-shaped pattern plate carrier with patterns on both sides thereof. Furthermore, in many cases, the time allowed for core insertion is not sufficient because such time is dependent on that needed for producing the cope.

Although it is true that the core insertion time might be prolonged without prolonging the cycle time for the production of the cope if the core insertion station of such a mold making machine were designed in the form of a turntable or conveyor loop with four straight sides, in the case of such a mold making installation it would then be necessary to multiply the number of lower flasks to correspond to the number of deposit positions on the core insertion station so that the initial plant costs would be considerably increased.

SUMMARY OF THE INVENTION

One object of the invention is to widen the field of application of a low noise and low dust vacuum molding blowing method.

A further object of the invention is to so improve the mold making installation of the type initially mentioned that there is not only an even lower overall height of the single station vacuum mold blowing machine but furthermore the possibility of allowing more time for the core insertion time without extending the cycle time of the mold making machine, while at the same time paying due regard to economic considerations. In this respect the initial plant costs are to be as low as possible and, more especially, the number of machine flasks is to be significantly reduced.

A further objective of the invention is to open up the possibility of optimum matching of the height of the blocks of the molds to the respective pattern height so that even if there are frequent changes in the pattern schedule it is possible to ensure a minimum sand consumption and a lower energy requirement for the transport of the molds.

In order too achieve these or other objects of the invention, a method for the production of horizontally divided flaskless sand molds, whose drags and copes are molded in the same mold making station of a vacuum mold blowing machine, in which firstly a flaskless drag is molded and inverted and moved out of the mold making station into a core insertion station, from which after the fitting of one or more cores, it is moved back into the mold making station where it is united with a block cope, which has been produced in the meantime, whereafter the now finished block mold is stripped and placed onto a casting line, is characterized in that after inverting it each drag is deposited on a mold transporting device having locating means and prior to removal from the vacuum mold blowing machine is stripped from the machine flask of the vacuum mold blowing machine and in that the associated cope is molded in the same machine flask as the respective drag.

In accordance with a preferred form of the invention the height of such mold components is matched to the height of patterns used for producing them and the drags are moved through a core insertion station having a plurality of positions at which drags may be deposited.

The invention further provides a mold making plant for the production of such horizontally divided flaskless molds from foundry sand, comprising a vacuum blow mold making machine adapted to produce drags and copes as mold components in alternate succession, a core insertion station and means for connection with a casting and cooling line and a palette return line, said mold blowing machine further comprising a mold flask attached to it and able to be inverted about a horizontal axis and adapted for production of said drags and copes, and means for stripping such flask from such drags and copes before removal thereof from the machine.

In such a plant it is possible for the molding machine to have a stationary mold table having positioning means for a mold component transport means and a pattern plate carrier and furthermore two pattern plate supports, each adapted to be fitted with a respective pattern plate on one side thereof and to be shifted between a position in said mold making station and a position outside the mold making machine.

It is possible to effect sealing by making a connection with the lower side of the pattern plate carrier and a vacuum or compressed air pump in the table. On the sides of the mold table it is possible to have two vertically shiftable conveyor roller sets, which may be each moved between an upper active position and a lower resting position for different transport directions.

The molding machine may further comprise a vertically movable sand bin with a blowing and closing grid at a lower end thereof and means for freely selecting the height of the grid in a blowing position thereof over the mold table. More specifically, the machine may have means for freeely and independently selecting the height of the blowing and pressing grid in a blowing position thereof for drags and copes.

As a further feature of the invention the core insertion station may comprise a rest for simultaneously holding a plurality of drags.

The core insertion station may comprise a turntable or a conveyor adapted to convey mold parts along the four sides of a rectangle.

The plant may further comprise a stroke sequence controller as part of the mold making machine, and having a shunt circuit for overriding it and producing exclusively drags or copes.

Further useful effects of the invention such as the design with a lower overall height of the mold making machine, economy in the use of foundry sand and power for transport and furthermore an economic allowance of more time for core insertion in the case of casting operations needing a high proportion of cores, will now be described with other features of the invention on the basis of the diagrammatic drawings.

BRIEF DESCRIPTION

DESCRIPTION OF A PREFERRED EMBODIMENT OF THE INVENTION.

Figure 1:
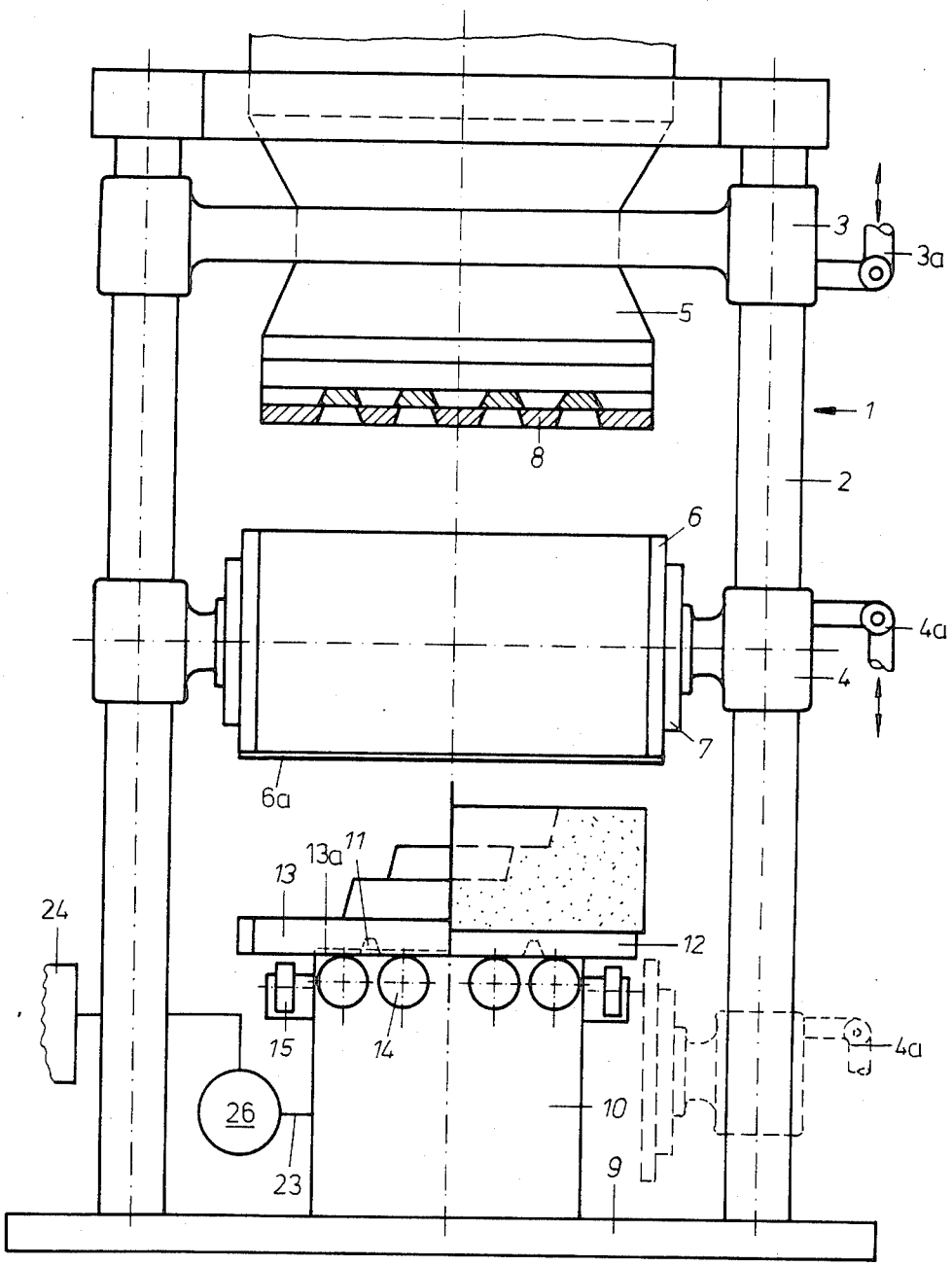
FIG. 1 shows a vacuum mold blowing machine.

The vacuum mold blowing machine 1 depicted in FIG. 1 in different possible working positions comprises four guide pillars 2, on which the support frame 3 for a foundry sand bin 5 and the support frame 4 for a machine mold flask 6 are able to be moved vertically by means of hydraulic cylinders 3*a* and 4*a*, respectively. The support frame 4 has an inverting device 7 in order to be able to invert or turn the machine flask 6 about a level axis.

At its lower end the sand bin 5 is fitted with a closing and opening blowing and pressing grid 8 small enough to be plunged into the flask 6.

A mold table 10 is fixedly mounted on the base plate 9 and on the top face of such table there are locating means for the transport palettes such as 12 and a flat hollow pattern plate carrier 13. The table 10 is equipped with connections 23 for a vacuum and compressed air supply 24, which are able to be connected with the cavity in the pattern plate carrier 13, seals 13*a* being provided for sealing off from the mold table 10. The mold table is surrounded by two vertically shiftable transport roller devices 14 and 15, which make possible the supply and removal of palettes and pattern plate supports in different directions.

Figure 2:
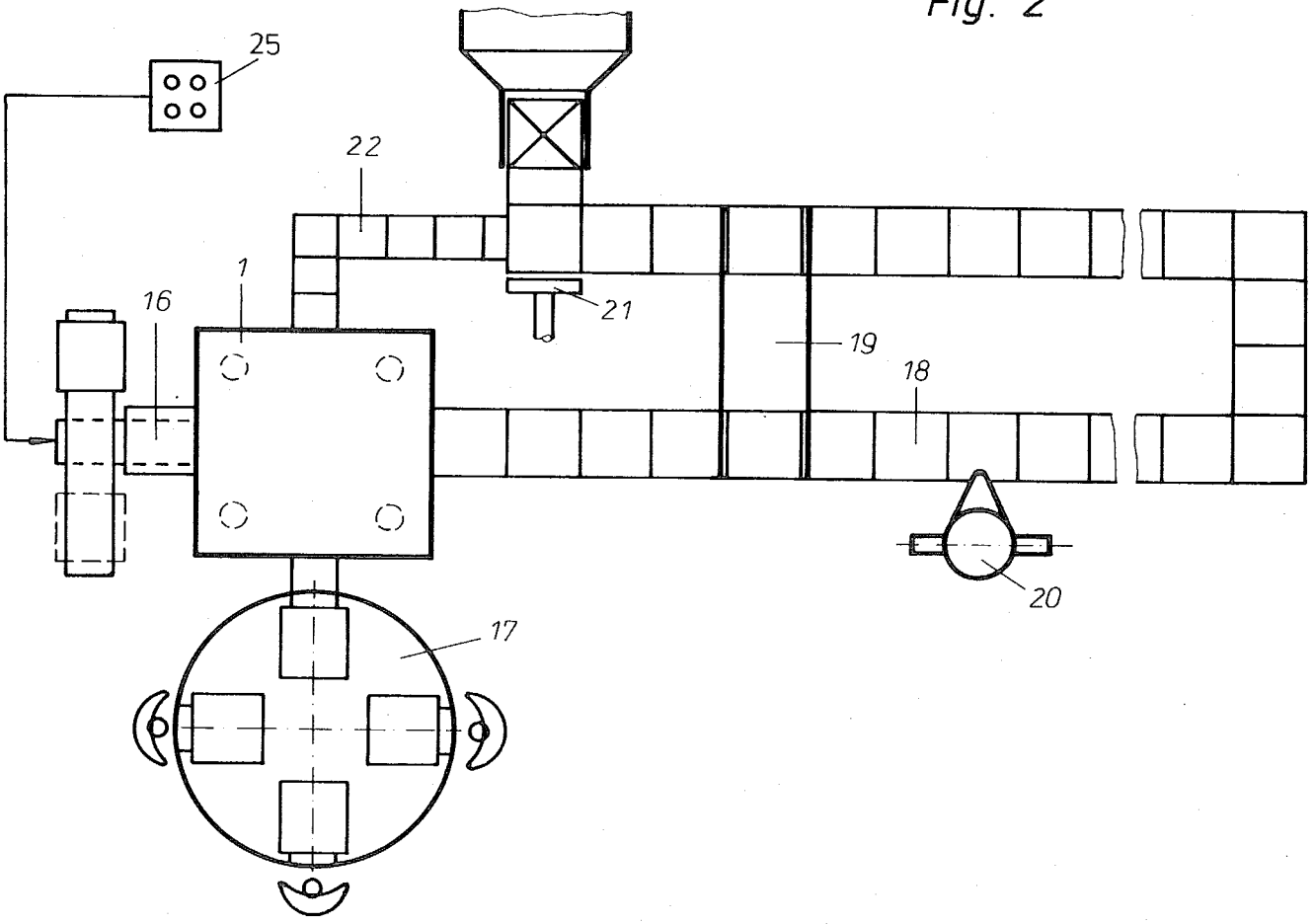
FIG. 2 is a plan view of a mold making installation incorporating the mold making machine of FIG. 1.

The mold making further comprises a pattern plate changing device 16 (see FIG. 2) making it possible to swap the two pattern plate carriers with the pattern plates for the cope and drag in the mold making station. Furthermore, the mold making machine 1 is provided with a core insertion station 17. which in the present instance is in the form of a turntable, but might take the form of a conveyor running along the four sides of a rectangle.

The mold making installation is coupled with a storage, casting and cooling line 18 with a reloading station 19, a casting station 20 and a shake out station 21 followed by a palette return line 22 for the return of the palettes to the mold making machine after being freed of sand block molds.

For the production of the molds the first step is for the pattern plate carrier 13 with the drag pattern to be pushed onto the mold table 10 and lowered thereonto, the carrier then being exactly positioned by means of locating means 11 and its cavity is joined up with the vacuum and compressed air connections in the mold table. Then the support frames 3 and 4 are lowered using the hydraulic cylinders 3*a* and 4*a*, respectively, under the control of a controller, till the machine flask is resting on the pattern plate carrier 13 with seals 6*a* therebetween and the blowing grid 8 plunged into the flask 6 to a degree dependent on the height of the pattern. Next the blowing grid is opened and a vacuum is suddenly produced in the mold table 10 by way of the valves 26 controlled by the controller 25. The vacuum is transmitted by way of the hollow pattern plate carrier and the air ducts, sealed by sand filters, in the pattern plate, the pattern and the top side of the pattern plate carrier into the flask and causes the foundry sand to be blown in. The foundry sand, compacted in the process, may then undergo further compaction by lowering the blowing grid, which is by now in the blowing position. If a blowing grid with hollow grid bars and with air nozzles is utilized, it is also however possible to cause pneumatic post-compaction by an air surge.

The next step is for the support frame 3 with the sand bin 5 and the support frame 4 with the flask 6 containing the drag to be moved upwards until there is sufficient clearance for inverting the flask 6. The step of lifting the drag from the pattern may if necessary, be aided by the compressed air in the cavity of the pattern plate carrier 13, after the pipe to the vacuum supply has been shut off again.

The pattern plate carrier 13 is now moved out of the mold making station, the flask is inverted through 180° using the inverting device 7 and a transport palette 12 is moved in using the transport roller device 15 (which is for this purpose lifted to be at a higher level than the transport roller device 14) lowered onto the mold table and positioned exactly using the locating means 11. And the support frame 4 with the flask 6 is lowered and the inverted drag is deposited on the palette 12. By further lowering of the support frame 4 into the position marked in broken lines in the right half of FIG. 1 the flask is stripped off the drag.

The transport roller device 15 is lifted up again and the drag is moved by the palette 12 (which has been cleared from the mold table 10) into the core insertion station 17. Then the support frame 4 with the flask 6 is moved back up into its initial position.

In the case of the use of a core insertion station with a plurality of places for supporting drags, the operations as described above are repeated until all such places have been occupied by a drag. The copes and drags, i.e. the top and bottom mold parts, are produced alternately.

For this purpose the pattern plate carrier with the cope pattern plate is moved into the mold making station and the cope is produced in the above-described manner by vacuum blowing. The flask 6 with the compacted cope is however in this case not inverted but is deposited on a drag fitted with its cores after the drag has been moved on the transport palette 12 from the core insertion station 17 into the mold making station and positioned therein. In the case of small flaskless molds the flask may be stripped by further lowering into the positions marked in broken lines so that the casting mold is removed. In the case of larger molds, in which the resilient or springback effect of the compacted foundry sand causes a marked increase in the size of the drag, it may be best to strip the flask 6 from the cope in an upward direction in order to avoid shaving off sand from the sides of the drag on plunging through the flask. For this purpose the sand bin is lowered to such a degree using the support frame that its turned-off grid 8 engages the top side of the cope resting on the drag. While the grid 8 is retained the support frame 4 is then moved up and the flask stripped.

After this the transport roller device 14 is lifted and the finished flaskless mold is moved out onto the supply, casting and cooling line 18 and a new mold making cycle may be commenced. At the end of a series of molds only the number of the drags corresponding to the number of drags at the core insertion station are molded to ensure that no superfluous drags or copes have to be shaken out in the mold making station or the core insertion station. The separate working steps therefore occur in program as dictated by the controller 25, there being a shunting circuit for this purpose if desired.

The supply, casting and cooling line 18 is preferably designed as in the International patent application PCT WO 81/02698 and has a reloading station 19, a casting station 20 and a shake out station 21 followed by a separate palette return line 22, extending to the mold making machine 1, on which the empty and mechanically brushed transport palettes are moved directly to the mold making machine 1.

I claim:

1. A mold making plant for producing horizontally divided, flaskless drag and cope parts of casting molds for reception on mold receiving pallets, comprising:

a vacuum molding machine;

a core insertion station connected to the vacuum molding machine;

means defining a casting and cooling path; and further means defining a plate return path, said means defining a casting and cooling path and said further means defining a plate return path being operatively associated with each other and with the vacuum molding machine;

said vacuum molding machine comprising:

a stationary mold table provided with transporting means and centering means; a foundry sand bin; means connected to the foundry sand bin for raising and lowering said foundry sand bin relative to said table; at least one pattern plate carrier positionable on the mold table alternatively with mold receiving pallets; a mold flask; an inverter connected to the mold flask for inverting the mold flask about a horizontal axis; and means for raising and lowering the mold flask and inverter relative to the mold table, wherein:

the transporting means serves to insert and remove the pattern plate carrier and pallets with respect to the mold table;

the centering means serves to position the pattern carrier and pallets with respect to the mold table;

the mold flask is adapted to engage the pattern plate carrier in order to form a mold cavity when the pattern plate carrier is positioned on the mold table, and to be stripped when a pallet is positioned on the mold table, releasing whichever mold part is involved.

2. The mold making plant as claimed in claim 1, wherein said vacuum molding machine comprises two pattern plate carriers, each adapted to be fitted with a respective pattern plate on one side thereof and to be shifted between a position in said vacuum molding machine and a position outside said vacuum molding machine.

3. The mold making plant as claimed in claim 2, further comprising means for connecting a lower side of said pattern plate carrier sealingly with means, located in said mold table for imparting pressure thereto.

4. The mold making plant as claimed in claim 1, wherein said transporting means comprises two vertically shiftable conveyor roller sets placed around said mold table.

5. The mold making plant as claimed in claim 1, wherein said foundry sand bin includes a blowing and pressing grid at a lower end thereof and means for freely selecting the height of the grid in a blowing position thereof over the mold table.

6. The mold making plant as claimed in claim 5, wherein the height of the blowing and pressing grid in a blowing position thereof may be freely selected independently for drags and copes.

7. The mold making plant as claimed in claim 6, wherein said core insertion station comprises a plurality of rests for simultaneously holding a plurality of drags.

8. The mold making plant as claimed in claim 7, wherein said core insertion station comprises a turntable.

9. The mold making plant as claimed in claim 7, wherein the core insertion station comprises a conveyor adapted to convey mold parts along the four sides of a rectangle.

10. The mold making plant as claimed in claim 7, further comprising a stroke sequence controller as part of said mold making machine, said controller having a shunt circuit for overriding it and producing exclusively drags or copes.

* * * * *